US005609105A

United States Patent [19]

Dettinger et al.

[11] Patent Number: 5,609,105

[45] Date of Patent: Mar. 11, 1997

[54] SHEET-CONVEYING DRUM FOR PRINTING MACHINES

[75] Inventors: Dietrich Dettinger, Heusenstamm; Roland Holl, Weiterstadt, both of Germany

[73] Assignee: MAN Roland Druckmaschinen AG, Germany

[21] Appl. No.: 529,518

[22] Filed: Oct. 6, 1995

[30] Foreign Application Priority Data

Sep. 23, 1994 [DE] Germany ..... 44 34 000.1

[51] Int. Cl.[6] ..... B41F 21/10

[52] U.S. Cl. ..... 101/409; 101/415.1; 101/410; 271/204

[58] Field of Search ..... 101/408, 409, 101/410, 411, 412, 415.1, 248; 271/82, 204, 277

[56] References Cited

U.S. PATENT DOCUMENTS

| | | | |
|---|---|---|---|
| 4,667,952 | 5/1987 | Jeschke et al. | 101/410 |
| 4,735,142 | 4/1988 | Haupenthal | 101/410 |
| 5,136,946 | 8/1992 | Becker | 101/410 |
| 5,333,547 | 8/1994 | Pristerer et al. | 101/409 |
| 5,390,601 | 2/1995 | Fricke et al. | 101/409 |
| 5,465,663 | 11/1995 | Bayer et al. | 101/409 |

FOREIGN PATENT DOCUMENTS

| | | | |
|---|---|---|---|
| 3641439 | 10/1987 | Germany | 101/410 |
| 3428668 | 4/1989 | Germany . | |
| 2098966 | 12/1982 | United Kingdom . | |

*Primary Examiner*—Christopher A. Bennett

*Attorney, Agent, or Firm*—Leydig, Voit & Mayer, Ltd.

[57] ABSTRACT

A sheet-conveying drum for use between units in a printing machine is provided with a plurality of gripper bridges arranged substantially circumferentially symmetrically on the drum surface. The gripper bridges hold the paper to the drum and include gripper impact strips that are adjustable radially relative to the drum in order to accommodate printing materials of different thickness. Each gripper impact strip is adjusted by means of a positioning device that is arranged on the drum radially inward of the gripper impact strip and mounted so that it can move axially relative to the drum and cam the gripper impact strip radially. The axial movement of each positioning device is brought about by an actuating device which is preferably a pneumatic cylinder and is disposed on the body of the drum at the free end of each positioning device. An energy supply sequentially actuates each actuating device resulting in the piston of each cylinder either extending or retracting. The extension and retraction of the actuating device moves the positioning device in the axial direction between adjustable stops thereby camming the gripper impact strips into two separate operating positions.

7 Claims, 1 Drawing Sheet

SHEET-CONVEYING DRUM FOR PRINTING MACHINES

FIELD OF THE INVENTION

The present invention relates generally to printing machines, and more particularly to a sheet-conveying drum in a sheet-processing printing machine.

BACKGROUND OF THE INVENTION

Typically, sheet-conveying drums are located between the printing units and between the further-processing units, such as varnishing works, of a rotary printing machine. A sheet-conveying drum generally has one or more gripper bridges that are distributed evenly about the circumferential surface of the drum. These gripper bridges hold the sheets of paper to the drum enabling the drum to convey the sheets from the previous unit to the next unit downstream in the printing machine. In order to accommodate sheets of different thickness, the gripper bridges have adjustable gripper impact strips.

A sheet-conveying drum of this type is known from DE 3,428,668 C2, in which the drum has a central adjustment mechanism for adjusting the gripper pads in each of the gripper bridges to accommodate sheets of different thickness. The central adjustment mechanism is arranged on the drum body and acts on a positioning mechanism which acts on means that simultaneously adjusts all of the gripper pads. Further, the central adjustment mechanism can be driven by a motor and controlled from a control panel. However, the central adjustment mechanism is not capable of separately adjusting each individual gripper pad. An individual adjustment of each gripper impact strip can only be accomplished by releasing the retained central adjustment mechanism and manually adjusting the individual gripper impact strips. Since it is not easy to individually adjust each gripper pad, inaccuracies in sheet receiving or sheet transferring between sheet transfer cylinders cannot be effectively remedied. This could lead to slipping or tearing of the sheets which would disrupt the registry of the sheets resulting in lower quality printing. In addition, adjustment of the gripper pads is quite complicated and time consuming, requiring both a basic adjustment step and a fine adjustment step. This leads to increased production down time, since the printing press must be shut down in order to adjust the gripper pads for a new sheet thickness.

GB 2,098,966 A discloses a sheet-conveying cylinder having a mechanism for adjusting the gripper pads in a gripper bridge for sheets of different thickness. The gripper pads for the gripper bridge are mounted on a gripper pad bar which extends axially to the cylinder. The mechanism comprises an adjusting rod which is arranged radially inward of the gripper pad bar and in contacting relation therewith and a plurality of adjustment screws that threadedly extend through the adjustment bar. The contact surfaces of the adjustment bar and the gripper pad bar are complimentarily slanted in the transverse direction of the bars. Angular movement of the adjustment screws causes the adjustment bar to move thereby displacing the gripper pad bar radially inward or outward to accommodate a different sheet thickness. This type of adjustment mechanism is undesirable because a significant amount of time is required to adjust the gripper bridge for a different sheet thickness since a plurality of screws must manually adjusted.

OBJECTS AND SUMMARY OF THE INVENTION

It is an object of the invention to provide a sheet-conveying drum that has gripper bridges which can be individually adjusted for printing materials of different thickness.

It is a related object of the invention to provide a sheet-conveying drum that has gripper bridges that can be adjusted quickly and easily with a minimum of down-time for the printing machine.

In accordance with these and other objects of the invention, a sheet-conveying drum is provided for use in a rotary printing machine. The sheet-conveying drum includes a plurality of gripper bridges which are arranged symmetrically on the surface of the drum. Each gripper bridge can be adjusted individually in order accommodate printing material of different thickness. Each gripper bridge consists of a gripper shaft, grippers, and gripper impact strips which are adjustable in substantially the radial direction. Each gripper bridge is paired with a positioning device which comprises a positioning rod having a plurality of attached wedge-shaped elements. The positioning rod is arranged on the drum radially inward of the gripper impact strip and is mounted so that it can move axially relative to the drum. The wedge-shaped elements are spring loaded into contacting relation with a plurality of complimentarily slanted wedge-shaped elements on the underside of the gripper impact strip. Thus, axial movement of the positioning rod cams the gripper impact strip in the radial direction.

The axial movement of the positioning devices is brought about by actuating devices which are disposed on the body of the drum at the free end of each positioning device. Each actuating device is coupled to a positioning rod and is connected to an energy supply. The energy supply controls each actuating device separately. In the preferred embodiment the actuating devices are pneumatic cylinders. In order to adjust the gripper impact strips for a printing material with a different thickness, the energy supply sequentially either extends or retracts each actuating device. The axial movement of each actuating device moves the coupled positioning rod in the axial direction thereby camming the gripper impact strip in the radial direction. The axial movement of the positioning rod is limited by adjustable stops which allow the gripper impact strip to be adjusted into two different positions.

These and other features and advantages of the invention will be more readily apparent upon reading the following description of a preferred exemplified embodiment of the invention and upon reference to the accompanying drawings wherein:

Figure 1:
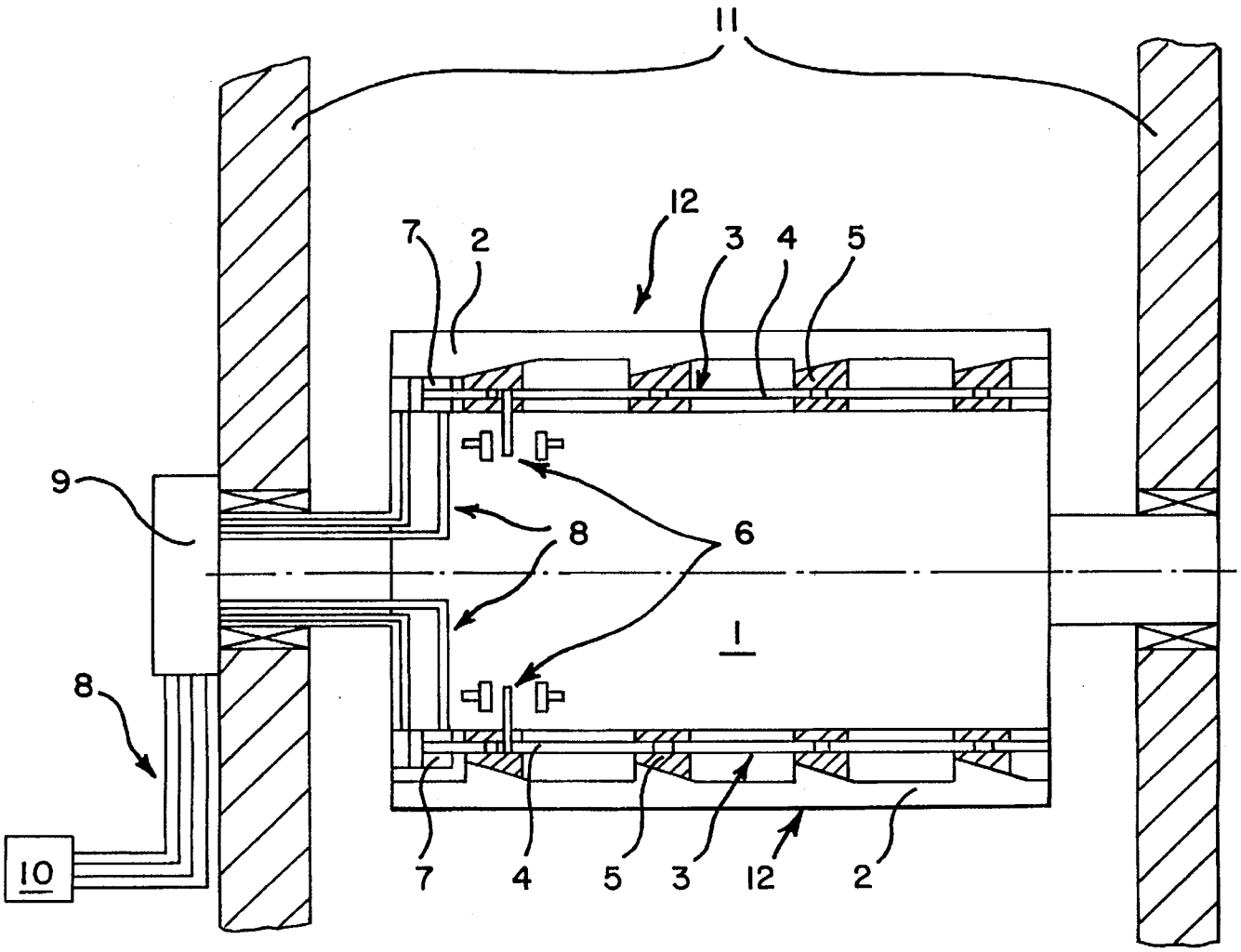
FIG. 1 is a front view of a sheet-conveying drum having two gripper bridges of the present invention.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

FIG. 1 illustrates in schematic form a sheet-conveying drum 1 which is arranged in an offset printing machine between the impression cylinders of two printing units. The illustrated drum i is double-sized in relation to a single-size impression cylinder and thus has two gripper bridges 12 arranged symmetrically (offset by 180° ) on the surface of the drum 1. While the illustrated embodiment is a double-sized sheet conveying drum it is understood that the present invention is suitable for single-size to quadruple-sized drums having the corresponding number of gripper bridges arranged symmetrically on the surface of the drum. In addition, the invention is suitable for sheet transfer cylinders, pregripper cylinders, and feeder drums. Each gripper bridge 12 consists of a gripper shaft, grippers, and gripper impact strips 2 which are adjustable in substantially the radial direction. For each gripper the gripper impact strip 2 includes associated pad blocks for the individual gripper pads. The drum 1 is rotatably supported by two journals each of which is mounted in a bearing in the side frame 11 of the printing machine.

Each gripper impact strip 2 has an associated positioning means or device 3 that can adjust the gripper impact strip 2 either radially inward or outward depending on the thickness of the printing material. The positioning device 3 is mounted on the drum 1 so that it can move axially relative to the drum. The illustrated double-size drum has two positioning devices arranged on the drum. Each positioning device 3 comprises a positioning rod 4 having a plurality of attached wedge-shaped elements 5 which are slanted longitudinally of the rod 4. The positioning rod 4 is arranged on the body of the drum 1 radially inward of the gripper impact strip 2 and moves axially relative to the drum. The wedge-shaped elements 5 on the positioning rod 4 are in contacting relation with a plurality of complimentarily slanted wedge-shaped elements disposed on the gripper impact strip 2 so that axial movement of the positioning rod 4 cams the gripper impact strip 2 in a substantial radial direction. The complimentary wedge shaped elements on the gripper impact strip 2 and the positioning rod 4 are held in contacting relation with each other by the bias of springs.

An actuating means or device 7, which in the preferred embodiment is a pneumatic cylinder, is disposed on the drum body 1 at the free end of each positioning device 3. Each actuating device 7 is coupled to the positioning rod 4 and is connected via a line system 8 to a rotary transducer 9 arranged on the drum journal. The rotary transducer 9 is connected to an energy supply 10 which controls each actuating device 7 separately. In the preferred embodiment, where the actuating devices 7 are pneumatic cylinders, the controlled compressed air supply takes place via a valve block. The axial stroke of each positioning device 3 is limited by adjustable stops 6. As a result, each gripper impact strip 2 can be adjusted into two operating positions by the positioning device 3. The first position, where the gripper impact strip 2 is fully raised, is suitable for processing paper. The second position, where the gripper impact strip 2 is fully lowered, is suitable for card. Those skilled in the art will appreciate that the actuating devices could also be a hydraulic cylinder or an electrically powered device.

The mode of operation is as follows: A sheet is fed to the drum 1 by an cylinder in an upstream printing unit. The drum receives the sheet with one of its gripper bridges 12. The sheet is then conveyed and subsequently passed on to an impression cylinder in a downstream printing unit. When it is necessary to process a material having a different thickness the gripper impact strips 2 on the drum 1 have to be adjusted radially either higher or lower. In order to make this adjustment, first, the energy supply 10 to the actuating devices 7 is activated either manually or automatically, for example from a control panel. Each actuating device 7 at the relevant gripper bridge 12 is actuated, in sequence, with compressed air. As a result, the piston of the pneumatic cylinder moves the positioning rod 4 which is coupled to the cylinder in the axial direction up to the stop. The axial movement of the positioning rod 4 cams the gripper impact strip 2 in the radial direction and into the first operating position. The second operating position can be achieved by reverse actuation of the actuating device 7, which in the preferred embodiment is a dual-action cylinder. Reverse actuation of the actuating device 7 moves the piston and, thus, the positioning rod 4 in the opposite direction up to the second stop. This movement of the positioning rod cams the gripper impact strip 2 into the second operating position. A two-stage adjustment has proved to be sufficient in printing practice. For example, a spacing of about 0.2 mm. between the upper edges of the gripper impact strips on a sheet conveying drum and the adjacent impression cylinder is suitable for paper and a spacing of about 0.7 mm. is suitable for card.

While this invention has been described with an emphasis upon preferred embodiments, it will be obvious to those of ordinary skill in the art that variations of the preferred embodiments may be used and that it is intended that the invention may be practiced otherwise than as specifically described herein. Accordingly, this invention includes all modifications encompassed within the spirit and scope of the invention as defined by the following claims.

We claim as our invention:

1. A sheet-conveying drum for conveying sheets of different thickness between two units of a printing machine comprising, in combination, a plurality of gripper bridges arranged substantially circumferentially symmetrically on the surface of said drum, each of said gripper bridges including a gripper shaft, a gripper, and a gripper impact strip, said gripper impact strips for each gripper bridge being movable substantially radially relative to said drum between individually adjustable, predetermined first and second positions, a respective positioning device associated with each of said gripper impact strips for causing said gripper impact strips to be moved in the radial direction relative to said drum when the respective positioning device is actuated, actuating devices on said drum each for actuating a respective one of said positioning devices, an energy supply, and a rotary transducer for separately supplying energy from the energy supply to said actuating devices to separately actuate the actuating devices and the respective positioning devices between said predetermined first and second positions.

2. A sheet-conveying drum as defined in claim 1 wherein each said gripper impact strip includes a plurality of wedge-shaped elements attached thereto and each said positioning device includes an axially movable positioning rod having a plurality of complimentary wedge-shaped elements attached thereto that are in contacting relation with said plurality of wedge-shaped elements attached to said gripper impact strip whereby axial movement of said positioning rod acts to cam said gripper impact strip substantially in the radial direction.

3. A sheet-conveying drum as defined in claim 2 wherein the axial movement of said positioning rod is limited by adjustable stops.

4. A sheet-conveying drum as defined in claim 1 wherein said drum has two gripper bridges.

5. A sheet-conveying drum as defined in claim 1 wherein said drum has three gripper bridges.

6. A sheet-conveying drum for conveying sheets of different thickness between two units of a printing machine comprising, in combination, four gripper bridges arranged substantially circumferentially symmetrically on the surface of said drum, each of said gripper bridges including a gripper shaft, a gripper, and a gripper impact strip, said gripper impact strips being adjustable substantially radially relative to said drum, a respective positioning device associated with each of said gripper impact strips for causing said gripper impact strips to be moved in the radial direction relative to said drum when the respective positioning device is actuated, actuating devices disposed on said drum each for actuating a respective one of said positioning devices, and a control means including a rotary transducer for separately supplying energy to said actuating devices to separately actuate the actuating devices and the respective positioning devices.

7. A sheet-conveying drum for conveying sheets of different thickness between two units of a printing machine comprising, in combination, a plurality of gripper bridges arranged substantially circumferentially symmetrically on the surface of said drum, each of said gripper bridges including a gripper shaft, a gripper, and a gripper impact strip, said gripper impact strips being moveable substantially radially relative to said drum, a respective positioning device associated with each of said gripper impact strips for causing said gripper impact strips to be moved in the radial direction relative to said drum when the respective positioning device is actuated, actuating devices disposed on said drum each for actuating a respective one of said positioning devices, said actuating devices each including an air cylinder, a pressurized air supply, and a rotary transducer for separately supplying pressurized air from said air supply to said air cylinders to separately actuate the actuating devices and the respective positioning devices.

* * * * *